United States Patent [19]

Argentiero

[11] 4,169,021

[45] Sep. 25, 1979

[54] METHOD FOR PRODUCING TUBULAR METALLIZED CLOTH BELTS AND TUBULAR BELTS OBTAINED BY SAID METHOD

[76] Inventor: Pietro Argentiero, Via Leoni, 9 - Como, Italy

[21] Appl. No.: 915,711

[22] Filed: Jun. 15, 1978

[30] Foreign Application Priority Data

Jun. 29, 1977 [IT] Italy ..... 25190 A/77

[51] Int. Cl.[2] ..... C25D 5/54; C25D 7/04

[52] U.S. Cl. ..... 204/21; 74/231 S; 74/237; 204/38 E

[58] Field of Search ..... 204/21, 24, 38 E; 74/231 M, 231 S, 237, 238, 232

[56] References Cited

U.S. PATENT DOCUMENTS

| | | | |
|---|---|---|---|
| 785,541 | 3/1905 | Danilevsky et al. | 204/21 |
| 2,474,502 | 6/1949 | Suchy | 204/21 |
| 3,542,633 | 11/1970 | Goldsmith | 74/231 S |
| 3,683,712 | 8/1972 | Schiffli | 74/231 S |
| 3,871,411 | 3/1975 | Sato et al. | 204/21 |
| 3,938,399 | 2/1976 | Delfiol et al. | 74/232 |
| 3,962,511 | 6/1976 | Foti | 74/232 |
| 4,003,760 | 1/1977 | Labenski | 204/38 E |
| 4,015,038 | 3/1977 | Romanski | 74/232 |

FOREIGN PATENT DOCUMENTS

| | | | |
|---|---|---|---|
| 40-27400 | 12/1965 | Japan | 204/21 |
| 45-11801 | 12/1970 | Japan | 204/38 E |

*Primary Examiner*—T. M. Tufariello

*Attorney, Agent, or Firm*—Bucknam and Archer

[57] ABSTRACT

A method for making metallized tubular cloths is described which consists of introducing a tubular cloth into a galvanic bath, connecting the tubular cloth to the cathode of the electrolytic cell, while the bath contains an electrolyte, the cation of which corresponds to the metal to be deposited on the cloth; and holding the tubular cloth in the galvanic bath for a period of time sufficient to obtain by electroplating the desired metal thickness on the surface of the cloth.

According to one embodiment of the invention, the galvanic bath contains salts of two or more metals.

2 Claims, 2 Drawing Figures

METHOD FOR PRODUCING TUBULAR METALLIZED CLOTH BELTS AND TUBULAR BELTS OBTAINED BY SAID METHOD

The present invention relates to a method for producing metallized cloth tubular belts.

More particularly the present invention relates to a method for producing metallized cloth tubular belts, particularly suitable for the making of homogeneous and high accuracy conveying belts.

As it is known, in some working steps, such as in the continuous type of press, it is necessary to provide conveyor belts which, in addition to an optimal thermal and/or electrical conductivity, are of a particularly high accuracy in order to prevent any uneveness of the ultimate product from occuring.

Due to this reason, the known conveyor belts, obtained by jointed cloth strips, are not satisfactorily suitable for such a use, in that said joints cause some uneveness of the product thereby defects are experienced.

Accordingly, the main object of the present invention is to provide a method for making tubular metallized cloth webs or belts, made of optimal thermal and/or electrical conductivity metallized cloth, and suitable for forming conveyor belts of high homogeneity and precision.

The aforesaid and other objects are achieved by a method comprising the steps consisting of providing a tubular cloth, introducing said tubular cloth in a galvanic bath, connecting said tubular cloth to the cathode of said cell bath, containing an electrolyte the cation whereof is that of the metal to be deposited on said cloth; and holding said tubular cloth in said galvanic bath for a period of time which is sufficient to obtain by electroplating a desired metal thickness on the cloth surfaces.

Thus at the outlet of said galvanic bath a metallized tubular cloth is obtained of even thickness all along the length thereof, which may be directly used for forming high accuracy belts, for example for a continuous type of press.

Moreover, the tubular cloth made by the method of the present invention is able to be used in all cases in which optimal thermal and/or electric conductivity and resistance against chemicals in general are required. To this end, it is preferred to apply on the tubular cloth metallized surface a layer of polytetrafluoroethylene.

In order to better understand the underlying concept of the present invention and put in practice the invention itself, the method for making metallized tubular cloths according to the present invention will be thereinafter described with reference to the figures of the accompanying drawing illustrating an exemplificative and not limitative preferred embodiment of the invention, in which.

Figure 1:
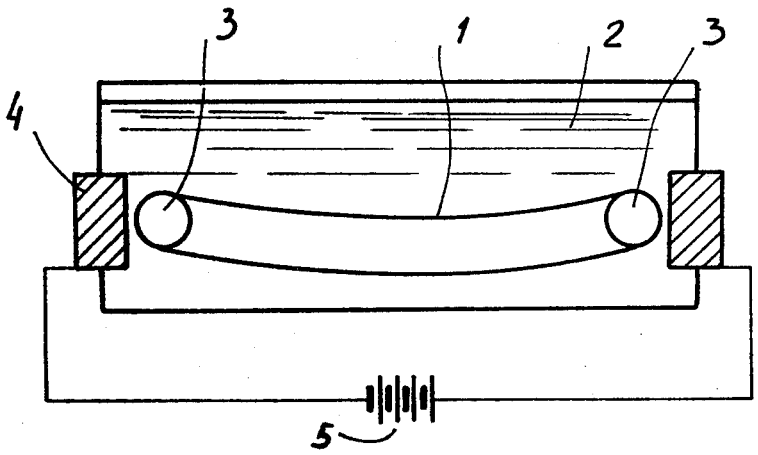
FIG. 1 is a schematic view of an apparatus suitable for carrying out the method of the invention.

Referring particularly to FIG. 1, the method according to the present invention provides for the using, as a starting material, a tubular cloth (1) obtained, for example, on circular looms or by other known systems.

The tubular cloth (1) consists of an endless belt, loopwise closed, and may comprise yarns of any natural, artificial or synthetic fibres, preferably of a type effective to resist against high temperatures, such as above 200° C.

The tubular cloth (1) is inserted in an electrolytic cell (2) the electrolyte of which consists of a salt the cation whereof is that of the metal to be deposited.

Optionally, in the bath of the electrolytic cell (2) salts of two or more different metals may be introduced to provide the electro-plating of an alloy on the surfaces of the cloth (1).

The cloth (1) is supported in any convenient way, for example by passing said cloth on a pair of continuously rotated rollers (3).

Moreover the tubular cloth (1) is electrically connected, by the most suitable known means, to the negative pole (4) of the d.c. current source (5) thereby it acts as the cathode of the galvanic cell (2).

Upon the passing of said d.c. current, a discharging of the ions at the poles of the electrolytic cell is obtained and hence the metal or metal alloy is desposited on both surfaces of the cloth connected to said negative pole (4).

The tubular cloth (1) is held in the cell (2) for a period of time which is sufficient to form on the surfaces of said cloth a desired thickness metal layer.

The thus obtained product may be used directly for forming conveyor belts, for example for a continuous type of press.

Being the tubular cloth (1) free of any joints, it allows for the making of particularly high accuracy conveyor belts, which, in turn, prevent any uneveness from occuring, for example in continuous type of presses.

Moreover, being the joints absent, a less wear of the conveyor belts occurs with respect to that of the known conveyor belts, these latter being obtained from jointed cloth strips.

If desired, the tubular cloth (1) may be subsequently subjected to a further treating for applying a surface coating of polytetrafluoroethylene (this product being commercially available under the name teflon) or PTFE, FEP, or of a fluorocarbon resin in general.

Figure 2:
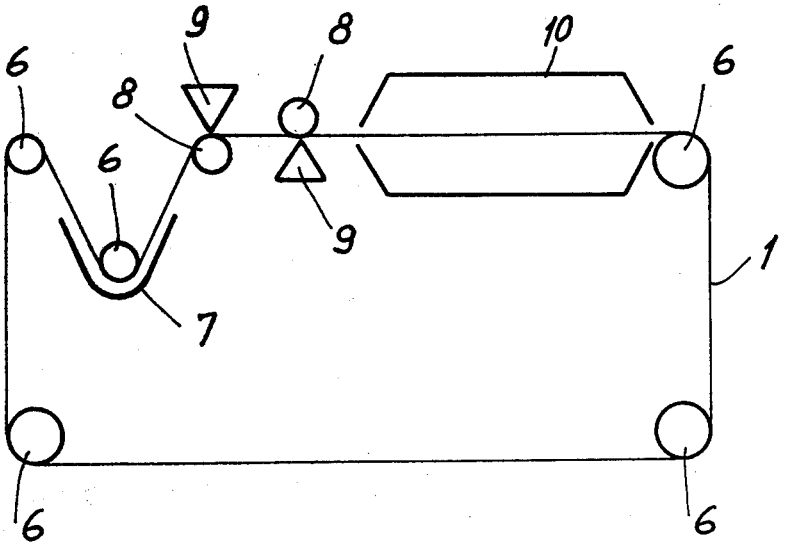
FIG. 2 is a schematic view of an apparatus effective to carry out an optional subsequent coating step by polytetrafluorethylene on the metallized cloth.

To this end, said tubular cloth (1) is located on transmission rollers (6), as it is schematically shown in FIG. 2, and uniformly moved, causing said tubular cloth (1) to pass through a tank (7) containing said PTFE or fluorocarbon resin at a fluid state.

Thus the tubular cloth (1) is covered, on both surfaces thereof, by a resin layer the thickness of which is adjusted depending on the spacing between the pair rollers (8) and the related blades (9).

The covered metallized cloth (1) is then thermally treated by causing said cloth to pass through a chamber (10) said chamber being heated for example by electrical resistances.

In particular, the temperature of the chamber (10) is adjusted or controlled depending on the sliding speed of the cloth (1) thereby allowing for a complete polymerization of the PTFE layers.

From the above description it is apparent that the method according to the present invention allows for the obtaining of looped belts suitable for the making of continuous conveyor belts.

Said belts may be either only metallized or metallized and covered by PTFE, especially as they are to be used for continuous hot presses, said belts being of great functionality and practicity of use.

Obviously the invention is not limited to the sole embodiment which has been described, and several modifications and variations may be carried out within the spirit of the invention and without departing from the scope thereof.

I claim:

1. Process for preparing a seamless tubular conveyor belt which comprises the steps of preparing by means of a circular loom a tubular cloth from natural, artificial or synthetic yarns which are resistant at a temperature higher than 200° C.; introducing said belt into a galvanic bath containing as electrolyte at least one salt, the cation of which being the metal to be deposited; whereby a metallized belt is obtained, covering the metallized belt with a fluorocarbon resin coating by passing the cloth through a tank containing said resin in the fluid state; and heating the covered metallized cloth to complete the polymerization of said fluorocarbon resin.

2. A seamless tubular conveyor belt prepared by the process of claim 1.

* * * * *